US005534898A

United States Patent [19]

Kashino et al.

[11] Patent Number: 5,534,898

[45] Date of Patent: Jul. 9, 1996

[54] INK JET HEAD, INK JET APPARATUS AND WIPING METHOD THEREFOR

[75] Inventors: Toshio Kashino, Chigasaki; Tsuguhiro Fukuda, Yokohama; Noribumi Koitabashi, Yokohama; Hiroshi Tajika, Yokohama; Atsushi Arai, Kasukabe; Hiromitsu Hirabayashi, Yokohama, all of Japan

[73] Assignee: Canon Kabushiki Kaisha, Tokyo, Japan

[21] Appl. No.: 764,060

[22] Filed: Sep. 24, 1991

Related U.S. Application Data

[63] Continuation of Ser. No. 464,437, Jan. 12, 1990, abandoned.

[30] Foreign Application Priority Data

Jan. 13, 1989 [JP] Japan ..... 1-7472
Jan. 18, 1989 [JP] Japan ..... 1-9548

[51] Int. Cl.[6] ..... B41J 2/165

[52] U.S. Cl. ..... 347/33

[58] Field of Search ..... 346/1.1, 140 R; 347/33, 44, 47, 20, 63

[56] References Cited

U.S. PATENT DOCUMENTS 4,528,575 7/1985 Matsuda et al. ..... 346/140 R
4,935,753 6/1990 Lehmann et al. ..... 346/140 R
4,951,066 8/1990 Terasawa et al. ..... 346/140 R
4,959,673 9/1990 Noda ..... 346/140 R
5,065,158 11/1991 Nojima et al. ..... 346/140 R

FOREIGN PATENT DOCUMENTS 63637 11/1982 European Pat. Off. .
314513 5/1989 European Pat. Off. .
3438033 4/1986 Germany .
59-045163 3/1984 Japan .
62-13358 1/1987 Japan .
63-11353 1/1988 Japan .
88008370 11/1988 WIPO .

OTHER PUBLICATIONS

IBM Technical Disclosure Bulletin, vol. 20, No. 11A, published Apr., 1978, J. M. Huellemeier and H. R. Kruspe.

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

An ink jet recording head comprises:

a discharge port plate forming a discharge port for discharging ink;

an ink jet recording head body having a liquid path communicating with the discharge port; and a cover member for covering the entire surface of the discharge port plate except the peripheral area of the discharge port, and the end edges of the ink jet recording head body, the edges being opposed to each other.

34 Claims, 9 Drawing Sheets

INK JET HEAD, INK JET APPARATUS AND WIPING METHOD THEREFOR

This application is a continuation of application Ser. No. 07/464,437, filed Jan. 12, 1990, now abandoned.

BACKGROUND OF THE INVENTION

1. Field of the Invention

The present invention relates to an ink jet recording head, an ink jet recording apparatus and a wiping method therefor.

2. Related Background Art

The ink jet recording method achieves recording by discharging a droplet of recording liquid called ink, and depositing said droplet onto a recording medium. In the field of ink jet recording, there is known a structure in which a recording head is mounted on a carriage capable of scanning motion relative to the recording medium, said recording head being provided with a discharge port or ports for discharging liquid droplet, a liquid path communicating with each discharge port and having an energy generating member for forming the flying liquid droplet, and a liquid chamber communicating with said liquid paths and storing liquid to be supplied to said liquid paths.

There are already known various types of recording head, according to the method of liquid discharge.

Among these, the recording head of a type for providing the ink with thermal energy to generate a bubble therein and effecting the ink discharge by the state change of said bubble is advantageous in that the thermal energy generating elements and functional devices for driving said elements can be prepared in a process similar to that for preparing semiconductor devices, and the discharge ports for ink discharge and the liquid paths which communicate with said discharge ports and in which thermal energy is applied can be prepared by a micro-fabrication process.

Because of this fact, it is possible to increase the density of discharge ports in a recording head, responding for example to the requirements of improvement in the quality of recorded image and increase in the recording speed.

However, in such high-density recording head, the discharge ports have to be prepared uniformly with sufficient precision, since otherwise the direction of ink discharge becomes deflected, thereby deteriorating the quality of the recorded image.

Therefore, in order to easily ensure the precision of the form of discharge ports governing the liquid discharging performance, there has been proposed a method of forming the discharge ports and the discharge plane by adhering an orifice plate, or a discharge port forming member, in which the discharge ports are prefabricated, onto a plane having apertures communicating with the ink liquid chamber.

In such orifice plate, the discharge ports can be formed for example with excimer laser irradiation or a photoetching process with sufficient precision, so that the recording head can be given highly precise discharge ports.

Also such orifice plate is employed for preventing deflection in the liquid discharge resulting from difference in wetting property when the discharge plane is composed of plural members.

In the following there will be briefly explained an example of the conventional structure of a recording head and the method of preparation thereof, with reference to the attached drawings.

At first, on a substrate 131 (for example made of silica glass) on which arranged are discharge energy generating elements (for example electrothermal converting elements such as heat generating resistors for generating thermal energy) 132, as shown in a schematic perspective view in FIG. 1A, there are formed liquid path walls 133 and an outer frame 134 with a hardened film of photosensitive resin as shown in FIG. 1B, and a cover plate 135 provided with a filter 137 in an ink supply hole 136 is laminated thereon. The obtained laminate structure is cut and divided along a line C—C', in order to optimize the distance from the ink discharge ports to the energy generating elements 132, thereby obtaining an intermediate structure of the recording head.

Thereafter, as shown in a perspective assembly view in FIG. 1C, an orifice plate 138 is adhered to the cut plane of said intermediate structure. The orifice plate 138 is composed of a resinous material or a metal, and is provided for improving the ink discharge performance as explained before.

The recording head thus prepared is assembled in the ink jet recording apparatus.

In the above-explained structure, however, the orifice plate has to be very thin, on the order of several microns, in consideration of the discharge characteristics. Because of this fact, there are encountered various difficulties in maintaining the orifice plate in contact with the main body of the recording head.

For example, if the orifice plate is adhered to the aperture plane with an adhesive material, the discharge ports may be clogged by said adhesive material penetrating into the liquid paths by capillary action from the vicinity of the apertures.

In order to prevent such phenomenon, the adhesive material is not used around said apertures, and the orifice plate is maintained in contact with the aperture plane for example with a pressure plate.

On the other hand, in the ink jet recording apparatus, the face of discharge ports may be wetted by a portion of the ink droplets or satellite droplets scattered in the air, or the ink splashing back from the recording medium. Similar wetting may be caused by the moisture evaporated from the recording medium for accelerating the image fixation and condensed on said face of the discharge ports. Such wetting on the discharge port face undesirably affects the discharge performance, such as deflected discharge, and is generally eliminated by a wiping operation.

However, the recording head having the discharge face formed with such orifice plate may pose various problems in the wiping operation. For example the mechanical force of wiping, being exerted repeatedly on the orifice plate, may result in peeling thereof from the plane of apertures. Also the ink removed by wiping may be deposited between the orifice plate and the pressing member therefor, thus eventually clogging the discharge ports.

Furthermore, the conventional ink jet recording head explained above is often associated with following drawbacks:

(1) A cleaning operation with a wiping member is generally required for preventing discharge failure, unevenness in density etc, resulting from deposition of ink or dust in the discharge ports, but the contact of said wiping member with the orifice plate may result in peeling thereof or scraping of said wiping member at the edge of the recording head, thereby generating dusts and deteriorating the durability or reliability of not only the wiping member but also the recording head itself;

(2) The adhesive material usually employed in adhering the orifice plate to the recording head tends to penetrate into the liquid paths, thus eventually clogging said liquid paths. Thus the recording head is poor in production yield and in mass producibility; and (3) If the adhesive material is not used around the ink discharge ports in order to present penetration of the adhesive material into the liquid paths and to prevent the low mass producibility resulting from the difficulty in the adhering operation, there may be formed a gap between the orifice plate and the recording head, thus giving rise to ink deposition therein and undesirably affecting the stability of ink discharge.

SUMMARY OF THE INVENTION

In consideration of the foregoing, an object of the present invention is to provide an ink jet recording head with improved cleaning of the ink discharge face, and capable of stable ink discharge, and an ink jet recording apparatus utilizing such recording head.

Another object of the present invention is to provide a wiping method in the ink jet recording apparatus, in which the wiping direction is determined according to the position of the discharge ports or the presence of a stepped structure formed by a pressing member, whereby prevented is the drawback of clogging of the discharge ports by ink or dust that is not completely removed by the wiping operation.

Still another object of the present invention is to provide an ink jet recording head capable of stable recording without discharge failure or deflection in the direction of ink discharge, resulting from the wiping operation, and an ink jet recording apparatus utilizing such ink jet recording head.

Still another object of the present invention is to provide an ink jet recording apparatus employing a recording head in which an orifice plate is maintained in position by a pressing member, capable of preventing the clogging of the discharge ports by the removed ink by effecting the wiping operation in an area not covered by said pressing member, in a direction according to the position of the discharge ports in said area and to the presence or absence of a stepped structure of said pressing member.

Still another object of the present invention is to provide an ink jet recording head comprising a discharge port plate forming a discharge port for discharging ink, an ink jet recording head body having a liquid path communicating with said discharge port and a cover member for covering the entire surface of said discharge port plate except the peripheral area of said discharge port and a pair of end edges of said ink jet recording head body, said edges being at least opposed to each other.

Still another object of the present invention is to provide an ink jet recording apparatus comprising a recording head, said head having an ink chamber provided with a discharge energy generating element for generating energy for discharging ink, an opening surface having an opening communicating with said ink chamber, a discharge port forming member having a discharge port jointed to said opening surface and provided in accordance with said opening, and a press member for covering a section of said discharge port forming member except a section on which at least said discharge port is provided, to maintain the joint of said discharge port forming member and a wiping member for wiping a surface of said discharge port forming member by relative movement with said recording head wherein said wiping member wipes the surface of said discharge port forming member from a narrower side to a wider side which are segmented in accordance with an arranging position of said discharge port in a section which is not covered by said press member.

Still another object of the present invention is to provide an ink jet recording apparatus comprising a recording head, said head having an ink chamber provided with a discharge energy generating element for generating energy for discharging ink, an opening surface having an opening communicating with said ink chamber, a discharge port forming member having a discharge port jointed to said opening surface and provided in accordance with said opening, and a press member for covering a section of said discharge port forming member except a section on which at least said discharge port is provided, to maintain the joint of said discharge port forming member, and a wiping member for wiping a surface of said discharge port forming member by relative movement with said recording head, wherein said wiping member wipes the surface of said discharge port forming member to a 10 direction where a step does not exist, which is able to be effected by covering said discharge port forming member with said press member.

Still another object of the present invention is to provide an ink jet recording apparatus comprising a recording head, said head having a discharge port forming member having a discharge port for discharging ink, a discharge energy generating element for generating energy for discharging ink from said discharge port, and a press member having an opening area in an area enclosing said discharge port and provided on said discharge port forming member, and a wiping member for wiping a surface of said discharge port forming member by relative movement with said recording head, wherein said wiping member wipes the surface of said discharge port forming member from a narrower side to a wider side which are segmented in accordance with an arranging position of said discharge port in said opening area.

Still another object of the present invention is to provide a method for wiping a discharge port surface of an ink jet recording apparatus comprising a recording head, said head having an ink chamber provided with a discharge energy generating element for generating energy for discharging ink, and opening surface having an opening communicating with said ink chamber, a discharge port forming member having a discharge port jointed to said opening surface and provided in accordance with said 10 opening, and a press member for covering a section of said discharge port forming member except a section on which at least said discharge port is provided, to maintain the joint of said discharge port forming member, and a wiping member for wiping a surface of said discharge port forming member by relative movement with said recording head, wherein the wiping of said wiping member is performed by wiping the surface of said discharge port forming member from a narrower side to a wider side which are segmented in accordance with an arranging position of said discharge port in a section which is not covered by said press member.

Still another object of the present invention is to provide a method for wiping a discharge port surface of an ink jet recording apparatus comprising a recording head, said head having an ink chamber provided with a discharge energy generating element for generating energy for discharging ink, an opening surface having an opening communicating with said ink chamber, a discharge port forming member having a discharge port jointed to said opening surface and provided in accordance with said opening and a press member for covering a section of said discharge port forming member except a section on which at least said discharge port is provided, to maintain the joint of said discharge port forming member and a wiping member for wiping a surface of said discharge port forming member by relative movement with said recording head, wherein the wiping of said wiping member is performed by wiping the surface of said discharge port forming member to a direction where a step does not exist, which is able to be effected by covering said discharge port forming member with said press member.

Still another object of the present invention is to provide a method for wiping a discharge port surface of an ink jet recording apparatus comprises a recording head, said head having a discharge port forming member having a discharge port for discharging ink, a discharge energy generating element for generating energy for discharging ink from said discharge port, and a press member having an opening area in an area enclosing said discharge port and provided on said discharge port forming member, and a wiping member for wiping a surface of said discharge port forming member by relative movement with said recording head, wherein the wiping of said wiping member is performed by wiping the surface of said discharge port forming member from a narrower side to a wider side which are segmented in accordance with an arranging position of said discharge port in said opening area.

DESCRIPTION OF THE PREFERRED EMBODIMENTS

Now the present invention will be clarified in detail by preferred embodiments thereof with reference to the attached drawings.

Figure 1A:
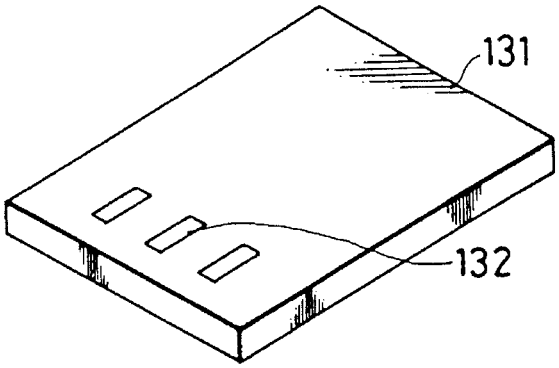
FIG. 1 A PRIOR ART
FIGS. 1A to 1C are schematic perspective views showing the structure of an ink jet recording head.
Figure 1B:
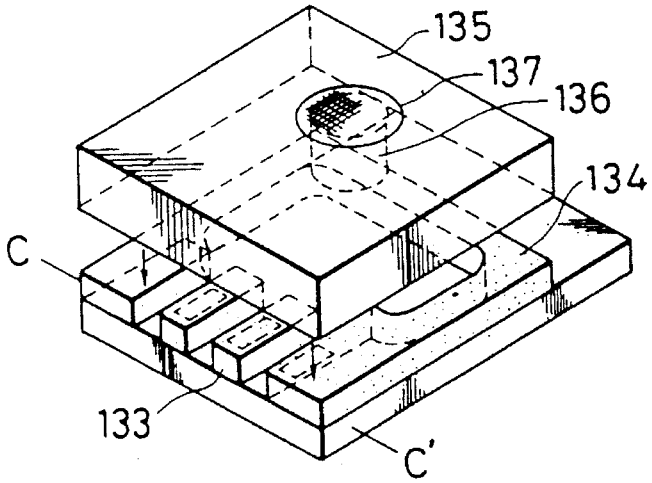
FIG. 1 B PRIOR ART
Figure 1C:
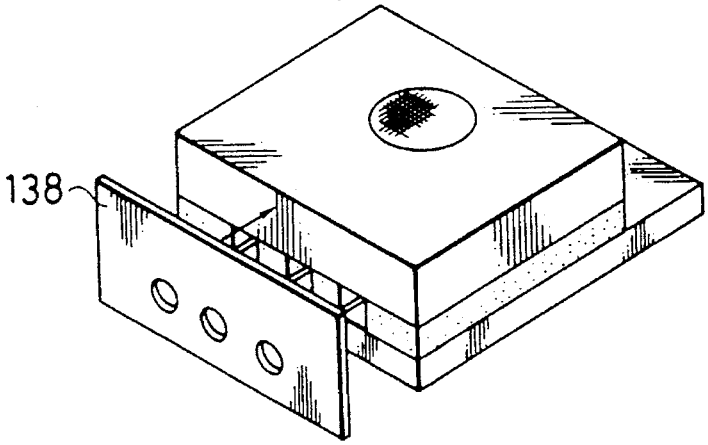
FIG. 1 C PRIOR ART
Figure 2A:
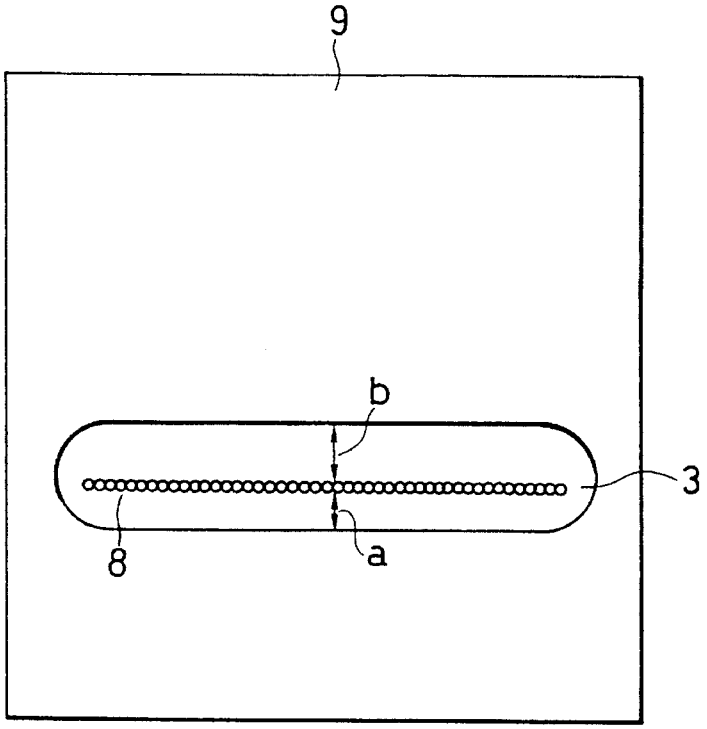
FIGS. 2A and 2B are respectively a schematic front view and a schematic lateral cross-sectional view of an ink jet recording head of the present invention.
Figure 2B:
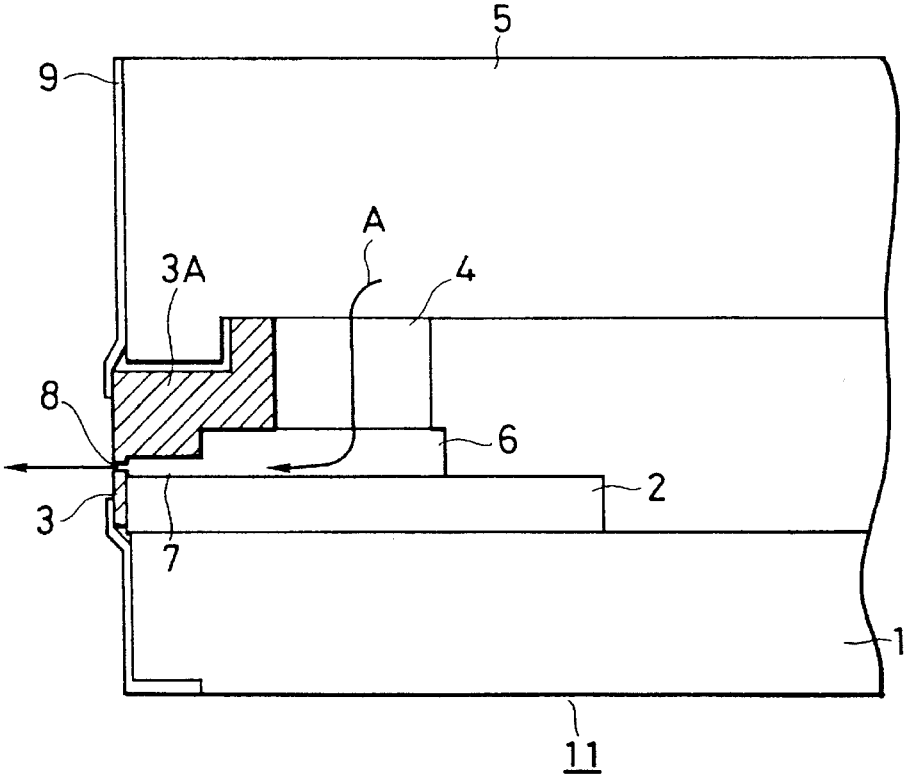

FIGS. 2A and 2B are respectively a schematic front view and a schematic lateral cross-sectional view of an ink jet recording head constituting a preferred embodiment of the present invention.

Referring to FIGS. 2A and 2B, on a base plate 1 of the recording head, composed for example of aluminum, there is adhered a substrate (heater board) 2, composed for example of silicon, on which are formed electrothermal converting elements serving as the thermal energy generating elements, and diodes serving as functional devices for driving said electrothermal converting elements. An orifice plate (discharge port forming member) 3 is formed integrally with a cover plate 3A provided with grooves for forming liquid chambers.

A filter 4 is provided in an ink supply hole leading from a chip tank 5 to a common liquid chamber 6, for the purpose of eliminating dusts and impurities from the ink flowing as indicated by an arrow A. After passing the filter 4, the ink flows into the common liquid chamber 6, and is supplied to plural ink chambers 7 communicating therewith, for discharge therefrom. A pressing member 9 is provided to maintain, by the elastic force thereof, the orifice plate 3 in close contact with the aperture plane (end face of the heater board 2 in this case). In the present embodiment said pressing member 9 is composed of stainless steel.

In the above-explained structure, the ink is supplied from an ink tank (not shown) to the tank 5 through a tube or the like, and then flows as indicated by the arrow A. At first it passes the filter 4 for eliminating dusts and impurities, then enters the common liquid chamber 6 and is guided to the liquid chambers 7. A bubble is generated in the ink by activating the electrothermal converting element provided in the liquid chamber; 7, and the ink is discharged from the discharge port 8 by the state change of said bubble. Since the discharge port is formed with sufficient precision, the ink droplet is discharged substantially perpendicularly to the discharge face without deflection.

The thickness of said orifice plate is preferably in the order of several microns, in order to obtain adequate values of the velocity of the discharged ink droplets, amount of ink droplet and refilling frequency, and in consideration of the distance between the thermal energy generating element and the discharge port. For these reasons, the orifice plate 3 is maintained in close contact, by the pressing member 9, with the end face of the heater board 2.

In the above-explained structure, an area around the discharge ports is not covered by the pressing plate as shown in FIGS. 2A and 2B, so that a step is formed between the plane of the orifice plate and the pressing plate. Besides, the structure is asymmetric with respect to the array of the discharge ports in that the distance from said array to said step is smaller, as indicated by a, on one side of said array and larger, as indicated by b, on the other side of said array, for example because of the requirement for maintaining close contact. Said pressing member serves not only for maintaining the orifice plate in position as explained above, but also for improving the sealing ability by the surface smoothness thereof at the capping operation, thereby retarding the clogging of the discharge ports.

In the following there will be explained a preferred example of the ink jet recording head usable in the present invention.

The ink jet recording head of the present invention solves the various drawbacks mentioned above and attains the aforementioned objects by a covering member which covers the orifice plate except for an area thereof around the discharge ports therein and at least a pair of end face of the main body of the recording head, thereby mechanically fixing the orifice plate onto the main body of the recording head.

More specifically the ink jet recording head of the present invention is featured by the covering member which covers the orifice plate, except for an area thereof around the discharge ports communicating with the liquid paths, and also at least a pair of mutually opposed end faces of the recording head, thereby securely fixing the orifice plate onto the recording head and preventing the displacement or peeling thereof without the use of adhesive material for fixing said orifice plate.

Now the present invention will be clarified in greater detail by the preferred embodiments thereof shown in the attached drawings.

Figure 3:
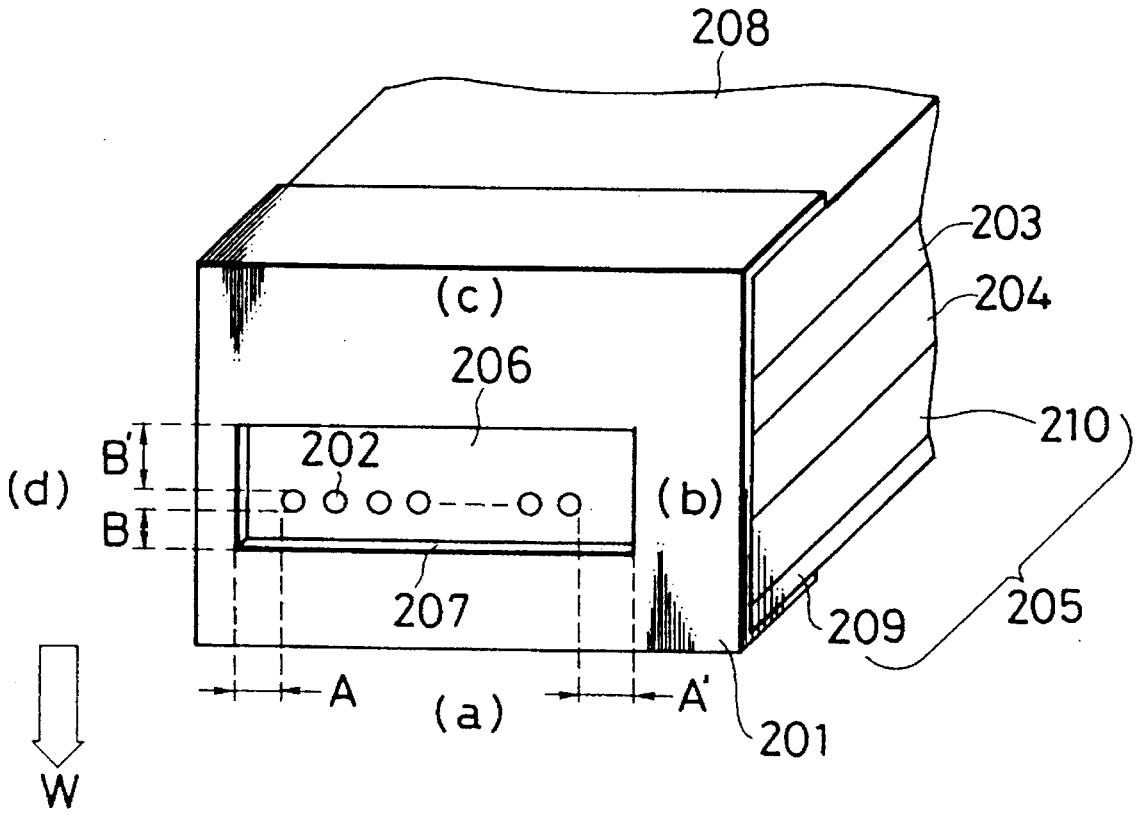
FIG. 3 is a schematic perspective view of an ink jet recording head of the present invention.

The ink jet recording head of the present embodiment is prepared, as shown in FIG. 3, by forming an outer frame 204 and unrepresented ink path walls by a hardened film of photosensitive resin on a substrate 205 consisting of an aluminum base plate 209 and a heater board 210, then laminating a cover plate 203 provided with an ink supply hole for ink supply from an ink tank 208 to said ink paths, and fixing an orifice (discharge port) plate 206 having ink discharge ports 202 therein onto the front face of the recording head by means of a front seal member 201. Said front seal member 201 covers not only the orifice plate 206 except for the area of discharge ports 202 but also the upper and lower edge portions of the front face of said recording head, thereby minimizing the scraping of the unrepresented wiping member resulting from the contact thereof with the upper and lower edges of the front face of the recording head at the cleaning operation of the discharge ports 202 by the movement of said wiping member in a direction a–c, and preventing the displacement or peeling of the orifice plate eventually caused by the movement of said wiping member. Consequently, if the wiping member moves parallel to the direction of the array of the ink discharge ports (direction b–d), said front seal member 201 is to cover the lateral edge portions of the front face.

The aperture 207 of said front seal member 201 is preferably so formed as to be separate from the ink discharge ports 202, in consideration of the moving direction of the wiping member in the cleaning operation of the ink discharge ports 202 and of the ease of removal of ink and dusts. The symbol W indicates the wiping direction.

The desired dimensions of the aperture 207 with respect to the ink discharge ports 202, namely the desirable distances between the edges of the aperture 207 and the ink discharge ports 202, are shown in Tab. 1 as a function of the moving direction of the wiping member. These figures are generally desirable distances though they are naturally variable according to various factors such as the size of the ink discharge ports, density of arrangement thereof, material of the wiping member, wiping speed thereof, thickness of front seal member etc.

TABLE 1

| Moving direction of wiping member | A (mm) | A' (mm) | B (mm) | B' (mm) |
|---|---|---|---|---|
| d→b | ≧0.3 | ≧1 | ≧0.3 | ≧0.3 |
| d←b | ≧1 | ≧0.3 | ≧0.3 | ≧0.3 |
| d⇆b | ≧1 | ≧1 | ≧0.3 | ≧0.3 |
| a→c | ≧0.3 | ≧0.3 | ≧0.3 | ≧1 |
| a←c | ≧0.3 | ≧0.3 | ≧1 | ≧0.3 |
| a⇆c | ≧0.3 | ≧0.3 | ≧1 | ≧1 |

Thus, in the present embodiment, if the wiping operation is conducted by the movement of the wiping member in a direction from c to a as shown in FIG. 3, the desirable dimensions are A≧0.3 mm, B≧1 mm, A'≧0.3 mm and B'≧0.3 mm as shown in Tab 1.

Figure 4A:
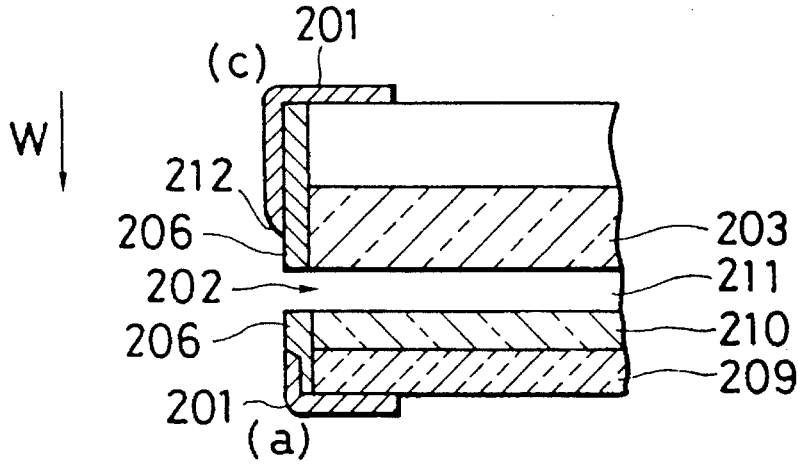
FIGS. 4A to 4C are schematic cross-sectional views showing another embodiment of the ink jet recording head of the present invention.

Also in consideration of removal of the ink and dusts in the cleaning operation, the aperture 207 of the front seal member 201 is free of any step to the orifice plate 206. In the present embodiment, therefore, for a wiping direction from c to a, a tapered portion 212 is provided at an edge, at the side (c), of the aperture 207 of the front seal member 201 as shown in FIG. 4A and a stepped portion is provided on the orifice plate 206 at the side (a) for aligning with the surface of the front seal member 201. It is therefore possible, in the wiping direction W, to eliminate the dust deposition at the stepped portion between the front seal member 201 and the orifice plate 206, and to prevent the scraping of the wiping member by the contact thereof with the edges of the aperture 207 of said front seal member 201.

Figure 4B:
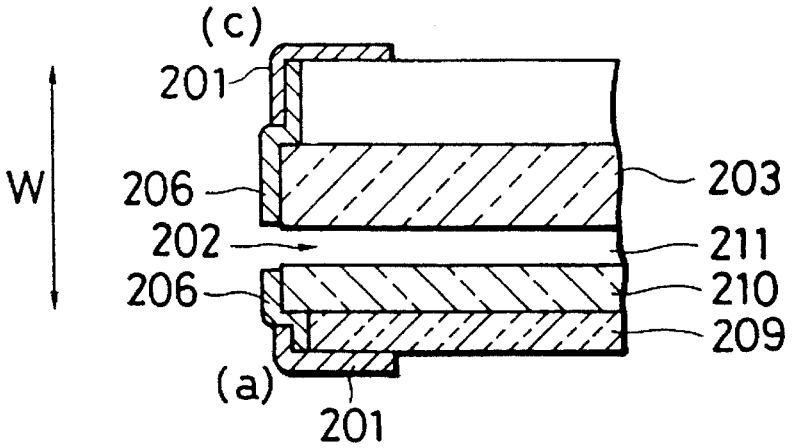

In case the wiping member reciprocates in the directions (a) and (c), it is again possible to prevent the dust deposition and the scraping of the wiping member by retracting the front seal member 201 from the ink discharge port 202 of the orifice plate 206 as shown in FIG. 4B.

Figure 4C:
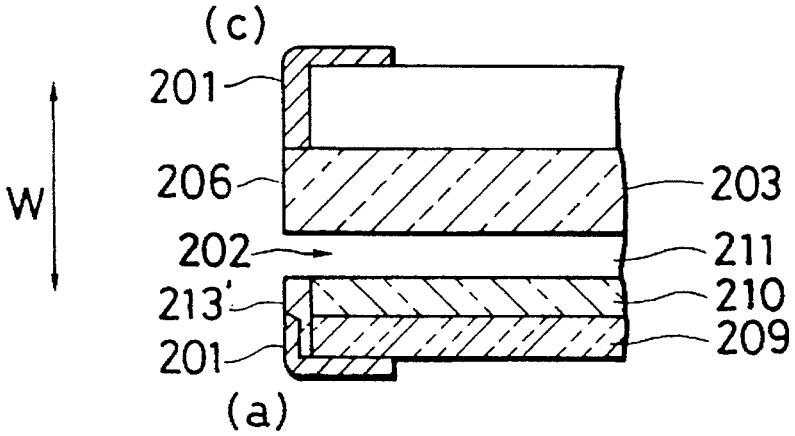

Now reference is made to FIG. 4C for explaining an embodiment in which the orifice plate is integrated with the cover plate 203 for the liquid path walls. In this embodiment, said cover plate 203 is extended to form a discharge port portion 213 which is stepped at the junction with the heater board 210 and the aluminum base plate 209, and said stepped portion is covered by an orifice plate 213' to obtain a smooth surface. Also the front seal member 201 covers the edges of the front face of the recording head and is aligned with the stepped portion of the orifice plate 213' and with the stepped portion between the chip tank 208 and the discharge port portion 213 of the cover plate 203. In the present embodiment, the orifice plate at the upper side, being integrated with the cover plate 203, is free from displacement or peeling even though it is not covered by the front seal member 201. Besides, since it is aligned in surface with the lower orifice plate 213' and with the front seal member 201, the wiping operation can be effected in reciprocating motion in a direction perpendicular to the direction of the array of the ink discharge ports. There can therefore be obtained similar advantages as in the foregoing embodiment, with respect to the elimination of ink and dusts and prevention of scraping of the wiping member.

In the present embodiment, the moving direction of the wiping member is assumed to be perpendicular to the direction of array of the ink discharge ports of the recording head, but a similar effect can be achieved even when said moving direction is parallel to said direction of array, by covering the lateral edges of the front face with the front seal member 201 and providing the aperture 207 of said front seal member 201 with tapered portions at lateral edges of said aperture.

In the present embodiment, the wiping operation on the discharge face of the above-explained structure in which the orifice (discharge port) plate is covered by the covering member is conducted in the following manner.

Figure 5A:
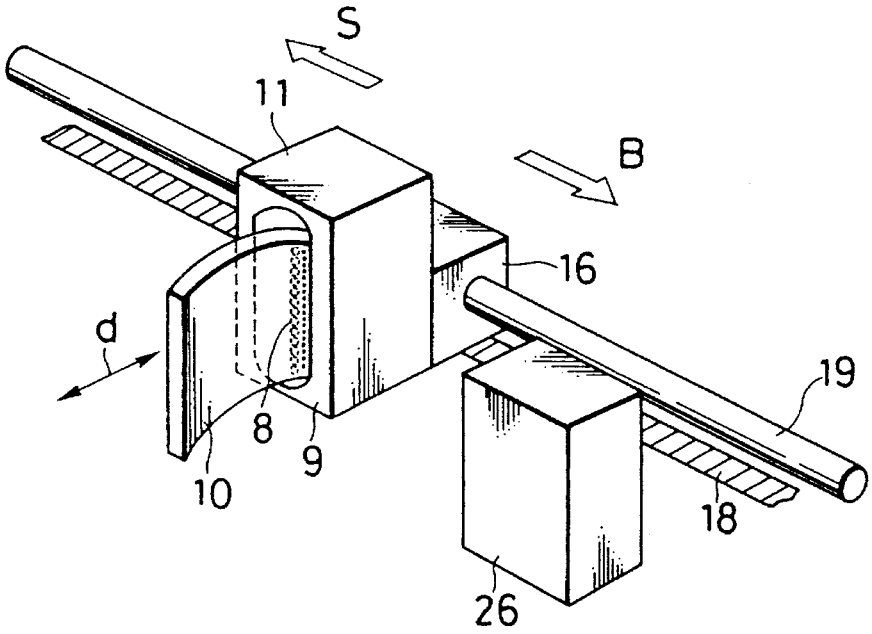
FIGS. 5A and 5B are respectively a perspective view and an enlarged lateral cross-sectional view schematically showing the wiping operation on the ink jet recording head shown in FIGS. 2A and 2B.

FIG. 5A is a schematic perspective view of a part of the ink jet recording apparatus showing the mode of wiping in the present embodiment.

A wiping blade 10 positioned next to a head recovery unit 26 and serving to wipe the discharge face of the recording head 11 is rendered movable in a direction d by a suitable driving mechanism to engage with or to be separated from said discharge face of the recording head 11, in a similar manner as the head recovery unit 26. The blade 10 is advanced into the moving path of the recording head 11 at suitable timing and moving direction in the course of reciprocating motion thereof thereby wiping the discharge face of the head 11 in relation to said reciprocating motion thereof.

In FIG. 5A there are also shown a carriage 16 supporting the recording head 11, a belt 18 connected to said carriage 16 and driven by an unrepresented carriage motor for moving said carriage 16; and a guide shaft 19 slidably engaging with said carriage 16 thereby defining the moving direction thereof. The carriage 16 is rendered movable in a main scanning direction S and in a backward direction B along said guide shaft 19.

Figure 5B:
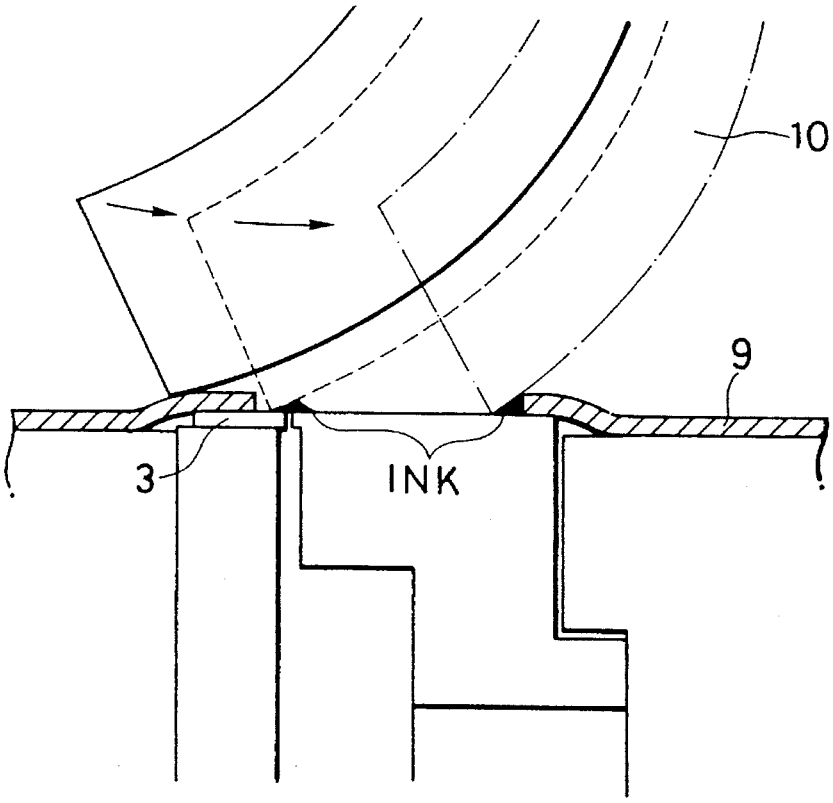

FIG. 5B is a lateral cross-sectional view showing the details of the wiping operation with said blade 10, wherein the wiping operation is conducted from a side of narrower space between the discharge port and the step to the side of wider space. The wiping operation in this manner eliminates the wetting or dusts in the vicinity of discharge port and regenerates the clean discharge face, thereby ensuring satisfactory ink discharge.

On the other hand, a wiping operation in the opposite direction from the side of wider space between the discharge port and the step to the narrower side is undesirable because the remaining ink and dusts are accumulated in the stepped portion of the narrower side, eventually blocking the discharge port which is positioned closer.

However such drawback can naturally be prevented if enough space is also provided in said narrower side.

Figure 10:
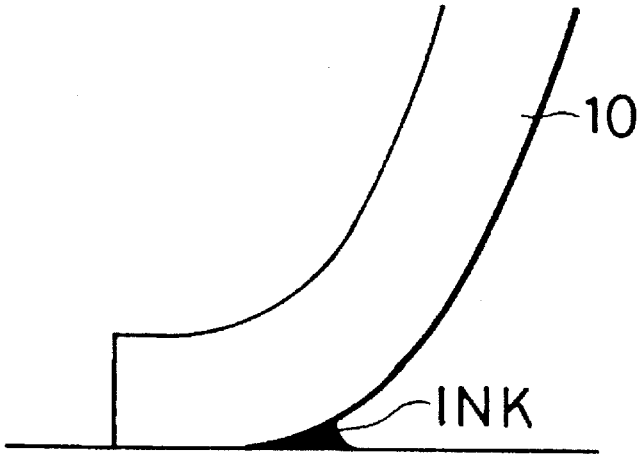
FIGS. 10 and 11 are schematic lateral views showing the ink removal by wiping with a blade.
Figure 11:
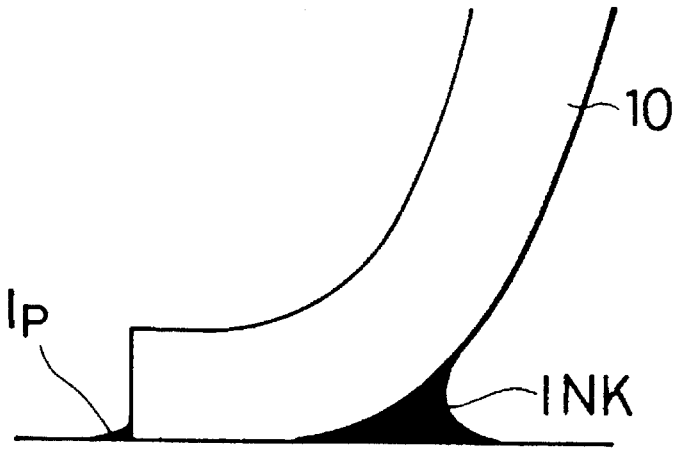

The conventional wiping method can completely remove the ink if the amount thereof on the discharge face is limited as shown in FIG. 10, but, if the amount of ink is larger as shown in FIG. 11, the ink passes under the blade 10 and cannot be removed completely. Also the dusts are accumulated in the stepped portion so that, after repeated wiping operations, such remaining ink and dusts may be extended to the position of the discharge port, thus eventually blocking said discharge port. In FIG. 11, the ink passing under the blade is represented by Ip.

Figure 9:
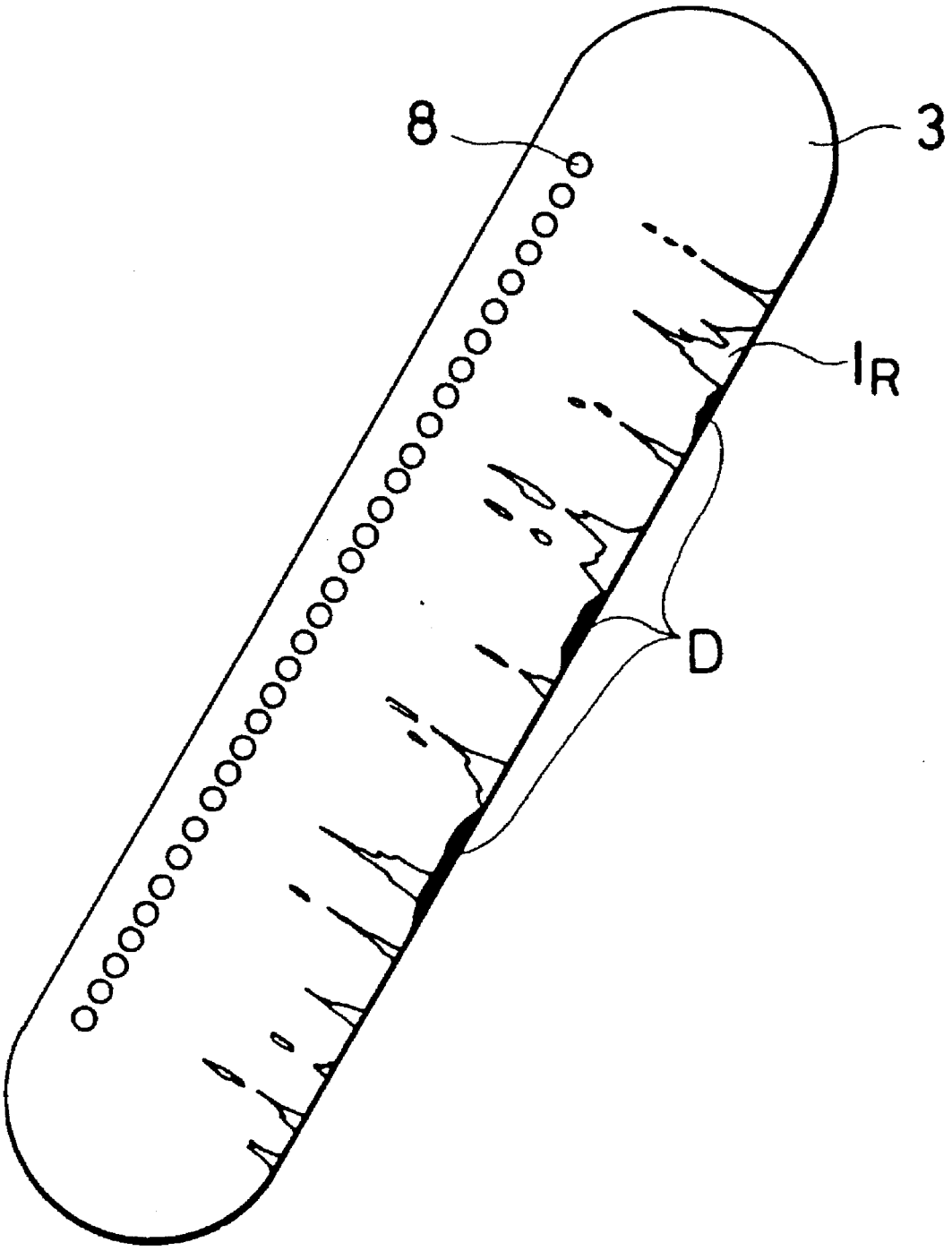
FIG. 9 is a schematic plan view of a discharge face after wiping, in an embodiment of the present invention.

However, if the wiping operation is conducted from a side of narrower space between the discharge port to the stepped portion to the wider side as in the present embodiment, the remaining ink $I_R$ and dusts D do not reach the position of the discharge ports as shown in FIG. 9 even in the worst case, so that the discharge ports are not affected and are capable of stable ink discharge.

Figure 6:
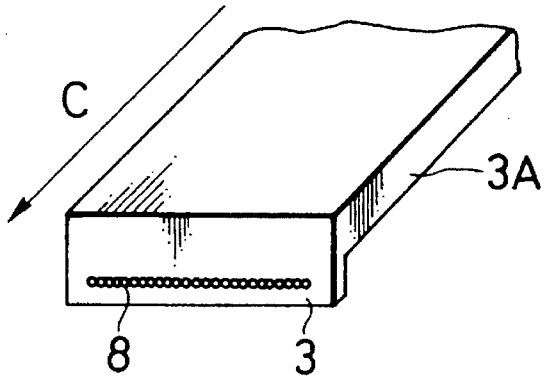
FIG. 6 is a perspective view of an orifice plate in another embodiment of the present invention.
Figure 7:
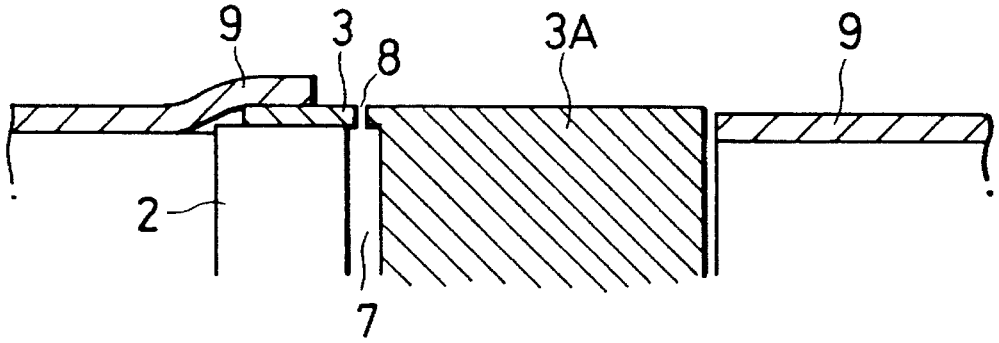
FIGS. 7 and 8 are schematic lateral cross-sectional views of other embodiments of the present invention.

FIG. 7 is a cross-sectional view of another embodiment of the recording head of the present invention, wherein the stepped structure is absent in a thicker part of the orifice plate 3, shown by C in FIG. 6, namely in the side of wider space between the discharge ports and the stepped portion in the foregoing embodiment. The wiping operation in this case is conducted from the side with the stepped portion to the other side without the step.

The ink discharge operation can be stabilized because the absence of stepped structure in the downstream side of the wiping operation avoids the accumulation of ink or dusts. Also the absence of the step at the downstream side eliminates the engagement of the blade with the step in the wiping operation, thus significantly improving the service life of the blade.

A more favorable effect can be obtained by the combination with the foregoing embodiment, namely by effecting the wiping operation from the narrower side, without the step in the downstream side.

The wiping member may be composed of an absorbent member instead of a blade for example of rubber, and the wiping operation in this case is conducted also from the side with a step to the side without a step. Said absorbent member is composed of for example, Rubicel (polyurethane continuous poam supplied by Toyo Polymer Co.) and is formed as a cylindrical roller or a blade which rotates or slides on the surface to be wiped. Said absorbent member is supported by a holder and is brought into contact with or separated from the recording head by a signal from the recording apparatus or by a mechanical drive.

Such structure can wipe all the discharge faces of the recording head with a single absorbent member even in a full color printer equipped with four heads for cyan, magenta, yellow and black colors.

Figure 8:
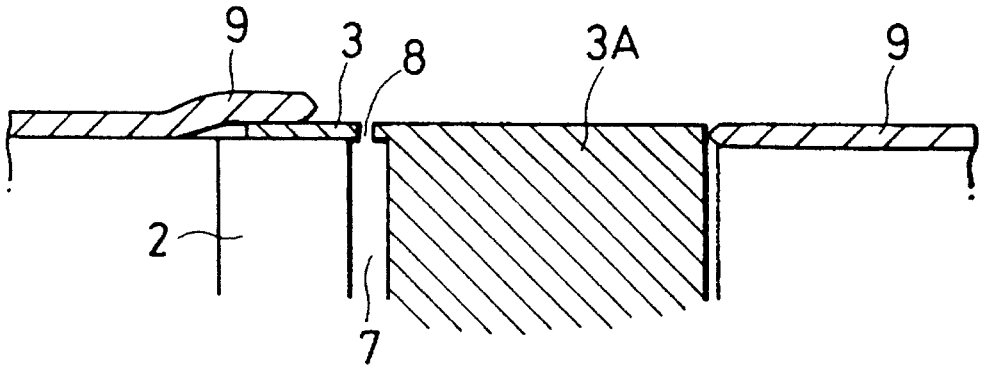

Also the service life of the wiping member can be improved by rounding the stepped portion as shown in FIG. 8. Particularly when the wiping member is composed of a soft material such as Rubicel, the low mechanical strength can be compensated by such rounded shape.

In an experiment of A4-size printing in a printer equipped with four recording heads, with three wiping operations in the course of printing of A4-size, the wiping member scarcely showed abrasion even after the printing of 30,000 sheets. Also there was no failure in ink discharge, and the quality of printing was satisfactory.

When the wet ink alone was to be removed, a cylindrical absorbent member exhibited extremely good wiping ability, and the durability on the step was satisfactory due to the cylindrical form.

Naturally an even better result can be obtained if water-repellent treatment is applied to the orifice plate and/or the front seal member.

In the foregoing embodiment there has been employed a recording head utilizing thermal energy generating elements, but the present invention provides similar effects on the recording heads of other types if a stepped structure is present of the face of discharge ports.

FIGS. 12 to 15 illustrate a certain embodiment on the wiping operation. As explained before, the wiping operation with the wiping member is conducted from a narrower side of the discharge face, with respect to the ink discharge ports, to the other wider side. Under these conditions, there can be considered four modes of wiping operation according to the positional relationship of the blade, cap and recording range.

Figure 12:
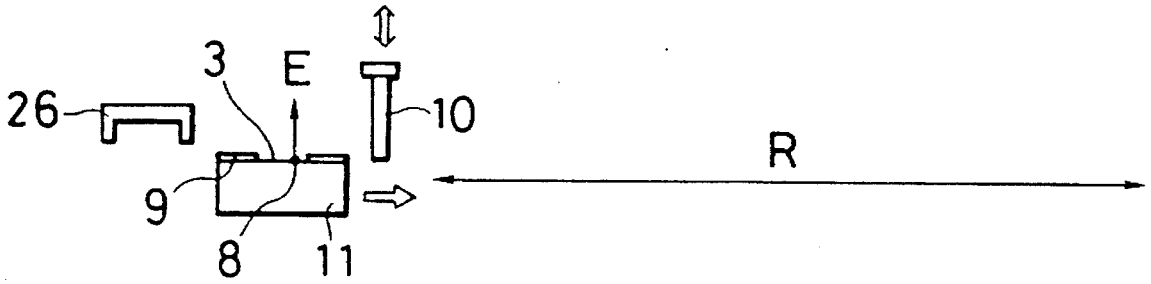
FIGS. 12 to 15 are schematic plan views showing the modes of wiping operation in the ink jet recording apparatus.

The first mode is to effect the wiping immediately before the recording, as shown in FIG. 12. In this mode, in case of an apparatus with plural recording heads, idle ink discharge has to be made for preventing color mixing after the wiping operation, and the recording head 11 has to be positioned immediately in front of the recording range or returned to the capping position for said idle ink discharge. An arrow E indicates the direction of ink discharge.

Figure 13:
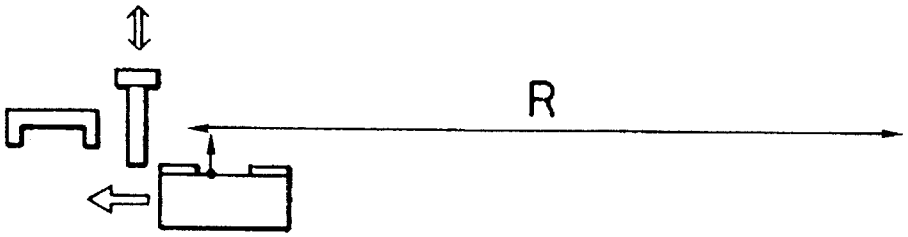

In the second mode, the wiping operation is conducted during the backward scanning after the recording as shown in FIG. 13. Even in an apparatus with plural recording heads, the idle ink discharge can be conducted during the capping operation. Thus the width of the apparatus can be reduced, and the time required for recording can also be reduced.

Figure 14:
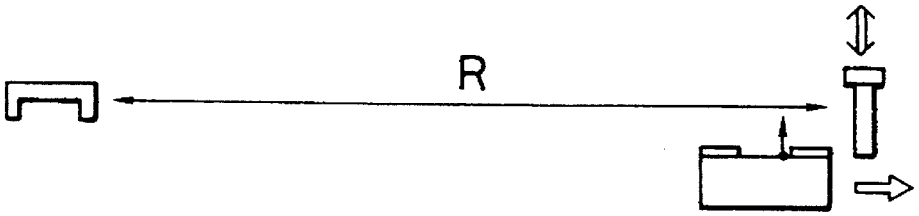

In the third mode, the blade 10 is positioned opposite to the cap 26 across the recording range, as shown in FIG. 14. Thus the wiping operation is conducted after the scanning for recording, and the idle ink discharge can be made at a position separate from the blade 10. If the recording is not conducted during the backward scanning, the idle ink discharge can also be conducted during the capping operation after the head returns to the position of the cap 26.

Figure 15:
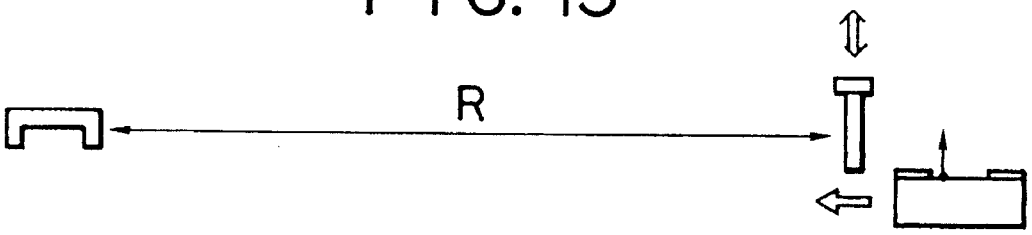

In the fourth mode, the wiping operation is conducted at the backward scanning as shown in FIG. 15. Color mixing may not be prevented in this mode if plural recording heads of different colors are present.

In the foregoing embodiments, the pressing member is employed for maintaining the orifice plate in position, but the wiping method of the present invention is naturally applicable to a case of wiping an aperture of a member which is provided, for any purpose, on a member bearing ink discharge ports.

As explained in the foregoing, the present invention is featured by a covering member which covers the orifice plate, except for an area of the ink discharge ports thereof, and the edge portions of the ink jet recording head, in order to prevent the scraping of the wiping member by the contact thereof with said edge portions of the recording head at the cleaning operation of the ink discharge ports thereof, thereby preventing the deterioration in performance of the recording head by thus scraped dust, and providing an ink jet recording head with durability.

Besides said covering member serves to mechanically fix the orifice plate onto the ink jet recording head, thereby dispensing with the adhesive material for fixing, thus avoiding the penetration of said adhesive material into the liquid paths. It also prevents the displacement or peeling of the orifice plate eventually caused by the movement of the wiping member, thereby ensuring stable ink discharge.

Furthermore, according to the present invention, the direction of wiping is determined according to the position of the discharge ports or the presence or absence of stepped structure by the covering member, thereby preventing the clogging of the discharge ports by the ink or dusts not completely removed by the wiping operation.

As a result, stable recording operation is ensured without the discharge failure or the deflection of discharge resulting from the wiping operation.

What is claimed is:

1. An ink jet apparatus using a head, said head having an ink chamber provided with a discharge energy generating element for generating energy for discharging ink, an opening surface having an opening communicating with said ink chamber, a discharge port forming member joined to said opening surface and having a discharge port provided corresponding to said opening, and a press member for covering a section of a surface of said discharge port forming member, excluding a portion of the surface on which at least said discharge port is provided, to maintain a connection of said discharge port forming member to said opening surface, wherein said portion is segmented by said discharge port into a narrow side and a wide side, said apparatus comprising a wiping member for wiping the surface of said discharge port forming member by relative movement with said head, wherein said wiping member wipes the surface of said discharge port forming member in a direction from said narrow side to said wide side.

2. An apparatus according to claim 1, wherein said discharge energy generating element is a thermal energy generating element.

3. An apparatus according to claim 2, wherein said thermal energy generating element is an electrothermal converting element.

4. An apparatus according to claim 1, wherein said press member and/or the surface of said discharge port forming member is treated with ink-repellent.

5. An ink jet apparatus using a head, said head having an ink chamber provided with a discharge energy generating element for generating energy for discharging ink, an opening surface having an opening communicating with said ink chamber, a discharge port forming member joined to said opening surface and having a discharge port provided corresponding to said opening, and a press member for covering a section of said discharge port forming member excluding a section on which at least said discharge port is provided thereby forming a step between said discharge port forming member and said press member, to maintain a connection of said discharge port forming member to said opening surface, said apparatus comprising a wiping member for wiping a surface of said discharge port forming member by relative movement with said head, wherein said wiping member wipes the surface of said discharge port forming member in a direction toward an area where said step between said discharge port forming member and said press member does not exist.

6. An apparatus according to claim 5, wherein said discharge energy generating element is a thermal energy generating element.

7. An apparatus according to claim 5, wherein said press member and/or the surface of said discharge port forming member is treated with ink-repellent.

8. An ink jet apparatus using a head, said head having a discharge port forming member having a surface with a discharge port for discharging ink, a discharge energy generating element for generating energy for discharging ink from said discharge port, and a press member being provided on said discharge port forming member and having an opening corresponding to said discharge port, wherein said discharge port forming member being segmented into a narrow side and a wide side by said discharge port, and said opening exposes a portion of the surface segmented by said narrow side and said wide side, said apparatus comprising a wiping member for wiping the surface of said discharge port forming member by relative movement with said head, wherein said wiping member wipes the surface of said discharge port forming member in a direction from said narrow side to said wide side.

9. An apparatus according to claim 8, wherein a step is formed when said press member is provided on said discharge port forming member and the wiping direction is a direction toward an area where said step between said press member and said discharge port forming member does not exist.

10. An apparatus according to claim 8, wherein said discharge energy generating element is a thermal energy generating element.

11. An apparatus according to claim 8, wherein said discharge energy generating element is a thermal energy generating element.

12. An apparatus according to claim 9, wherein said discharge energy generating element is a thermal energy generating element.

13. An apparatus according to claim 8, wherein said press member and/or the surface of said discharge port forming member is treated with ink-repellent.

14. An apparatus according to claim 9, wherein said press member and/or the surface of said discharge port forming member is treated with ink-repellent.

15. A method for wiping a discharge port surface of an ink jet apparatus, the ink jet apparatus including a head, said head having an ink chamber provided with a discharge energy generating element for generating energy for discharging ink, an opening surface having an opening communicating with the ink chamber, a discharge port forming member joined to said opening surface having a discharge port provided corresponding to the opening, and a press member for covering a section of the discharge port forming member excluding a section on which at least the discharge port is provided, to maintain a connection of the discharge port forming member to the opening surface, the apparatus further including a wiping member for wiping a surface of said discharge port forming member by relative movement with the head, wherein a surface of the discharge port forming member has a narrow side and a wide side not covered by the press member, the narrow side and the wide side being segmented by the discharge port, said method comprising the step of:

wiping the surface of the discharge port forming member with the wiping member from the narrow side to the wide side.

16. A method according to claim 15, wherein the discharge energy generating element is a thermal energy generating element.

17. A method according to claim 16, wherein the thermal energy generating element is an electrothermal converting element.

18. A method according to claim 15, wherein said press member and/or the surface of said discharge port forming member is treated with ink-repellent.

19. A method for wiping a discharge port surface of an ink jet apparatus, the apparatus including a head, said head having an ink chamber provided with a discharge energy generating element for generating energy for discharging ink, an opening surface having an opening communicating with the ink chamber, a discharge port forming member joined to said opening surface and having a discharge port provided in accordance with the opening, and a press member for covering a section of the discharge port forming member for excluding a section on which at least the discharge port is provided thereby forming a step between said discharge port forming member and said press member, to maintain a connection of the discharge port forming member to the opening surface, the apparatus further including a wiping member for wiping a surface of the discharge port forming member by relative movement with the head, said method comprising the step of:

wiping the surface of the discharge port forming member with the wiping member in a direction toward an area where the step between the discharge port forming member and the press member does not exist.

20. A method according to claim 19, wherein the discharge energy generating element is a thermal energy generating element.

21. A method according to claim 19, wherein said press member and/or the surface of said discharge port forming member is treated with ink-repellent.

22. A method for wiping a discharge port surface of an ink jet apparatus, the apparatus including a head, said head having a discharge port forming member having a discharge port for discharging ink, a discharge energy generating element for generating energy for discharging ink from the discharge port, and a press member being provided on the discharge port forming member and having an opening corresponding to the discharge port, the apparatus further including a wiping member for wiping a surface of the discharge port forming member by relative movement with the head, wherein the surface of the discharge port forming member has a narrow side and a wide side within the opening of the press member, the narrow side and the wide side being segmented by the discharge port, said method comprising the step of:

wiping the surface of the discharge port forming member with the wiping member in a direction from the narrow side to the wide side.

23. A method according to claim 22, wherein said press member and/or the surface of said discharge port forming member is treated with ink-repellent.

24. An ink jet head comprising:

a discharge port plate having a discharge port for discharging ink;

a cover plate having a groove that forms a liquid path communicating with said discharge port when said cover plate is joined to a substrate; and a cover member contacting and pressing to the substrate at least a part of said discharge port plate excluding a portion corresponding to said discharge port, wherein said discharge port plate includes a first area integral with said cover plate and a second area adjacent to said first area, said first area and second areas being on opposite sides of said discharge port, and said cover member contacts a portion of said second area of said discharge port plate which is closer to said discharge port than a portion of said first area of said discharge port plate contacted by said cover member.

25. An ink jet head according to claim 24, wherein said head further comprises a discharge energy generating element corresponding to said discharge port.

26. An ink jet head according to claim 25, wherein said discharge energy generating element is an electrothermal converting element for generating thermal energy.

27. An ink jet head according to claim 24, wherein said discharge port plate is treated with ink-repellent.

28. An ink jet head according to claim 24, wherein said discharge port includes a periphery and said cover member includes an opening for the portion of said discharge port plate corresponding to said discharge port, a distance between the periphery of said discharge port and the opening of said cover member being at least 0.3 mm.

29. An ink jet head comprising:

a discharge port plate having a discharge port for discharging ink;

an ink jet head body having a liquid path communicating with said discharge port; and a cover member for contacting and pressing at least a part of said discharge port plate excluding a portion corresponding to said discharge port, wherein said discharge port plate includes a thick portion and a thin portion, said thick portion and said thin portion being on opposite sides of said discharge port, and said cover member contacting an area of said thin portion of said discharge port plate which is closer to said discharge port than an area of said thick portion of said discharge port plate contacted by said cover member.

30. An ink jet head according to claim 29, wherein said discharge port plate is mechanically fixed to said ink jet head body through said cover member.

31. An ink jet head according to claim 29, further comprising a discharge energy generating element corresponding to said discharge port.

32. An ink jet head according to claim 31, wherein said discharge energy generating element comprises an electrothermal converting element for generating thermal energy.

33. An ink jet head according to claim 33, wherein said discharge port plate is treated with ink-repellent.

34. An ink jet head according to claim 29, wherein said discharge port includes a periphery and said cover member includes an opening for the portion of said discharge port plate corresponding to said discharge port, a distance between the periphery of said discharge port and the opening of said cover member being at least 0.3 mm.

* * * * *

UNITED STATES PATENT AND TRADEMARK OFFICE

CERTIFICATE OF CORRECTION

PATENT NO. : 5,534,898

DATED : July 9, 1996

INVENTOR(S) : TOSHIO KASHINO ET AL.

It is certified that error appears in the above-identified patent and that said Letters Patent is hereby corrected as shown below:

COLUMN 2

Line 65, "dusts" should read --dust--.

COLUMN 3

Line 7, "present" should read --prevent--.

COLUMN 4

Line 19, "10" should be deleted.
Line 45, "10" should be deleted.

COLUMN 5

Line 12, "comprises" should read --comprising--.

COLUMN 6

Line 12, "dusts" should read --dust--.
Line 25, "dusts" should read --dust--.
Line 29, "chamber; 7," should read --chamber 7,--.
Line 36, "ink" should read --the ink--.
Line 37, "droplet" should read --droplets--.

COLUMN 8

Line 3, "dusts" should read --dust--.
Line 43, "dusts" should read --dust--.

UNITED STATES PATENT AND TRADEMARK OFFICE

CERTIFICATE OF CORRECTION

PATENT NO. : 5,534,898

DATED : July 9, 1996

INVENTOR(S) : TOSHIO KASHINO ET AL.

It is certified that error appears in the above-identified patent and that said Letters Patent is hereby corrected as shown below:

COLUMN 9

Line 18, "dusts" should read --dust--.
Line 33, "the dusts are" should read --dust is--.
Line 35, "dusts" should read --dust--.

COLUMN 10

Line 4, "poam" should read --foam--.
Line 31, "plate and/or the" should read --plate.--.
Line 32, "front seal member." should be deleted.

COLUMN 11

Line 32, "dusts" should read --dust--.

UNITED STATES PATENT AND TRADEMARK OFFICE

CERTIFICATE OF CORRECTION

PATENT NO. : 5,534,898

DATED : July 9, 1996

INVENTOR(S) : TOSHIO KASHINO ET AL.

It is certified that error appears in the above-identified patent and that said Letters Patent is hereby corrected as shown below:

COLUMN 14

Line 14, "second areas" should read --said second area--.
Line 58, "claim 33," should read --claim 29,--.

Signed and Sealed this

Seventeenth Day of December, 1996

*Attest:*

Bruce Lehman

BRUCE LEHMAN

*Attesting Officer*

*Commissioner of Patents and Trademarks*